US007086939B2

(12) United States Patent
Wilkinson et al.

(10) Patent No.: US 7,086,939 B2
(45) Date of Patent: Aug. 8, 2006

(54) CHEMICAL MECHANICAL POLISHING RETAINING RING WITH INTEGRAL POLYMER BACKING

(75) Inventors: David Wilkinson, Aliso Viejo, CA (US); Colleen E. Hamilton, Orange, CA (US); Bryan David Hirschorn, Leominster, MA (US); Michael John Mangaudis, Worcester, MA (US)

(73) Assignee: Saint-Gobain Performance Plastics Corporation, Wayne, NJ (US)

( * ) Notice: Subject to any disclaimer, the term of this patent is extended or adjusted under 35 U.S.C. 154(b) by 193 days.

(21) Appl. No.: 10/804,569

(22) Filed: Mar. 19, 2004

(65) Prior Publication Data

US 2005/0208881 A1 Sep. 22, 2005

(51) Int. Cl.
*B24B 1/00* (2006.01)

(52) U.S. Cl. ..... 452/41; 451/285

(58) Field of Classification Search ..... 451/41, 451/28, 285–289

See application file for complete search history.

(56) References Cited

U.S. PATENT DOCUMENTS

| | | | |
|---|---|---|---|
| 5,944,593 | A | 8/1999 | Chiu et al. |
| 6,062,963 | A | 5/2000 | Lin et al. |
| 6,136,713 | A | 10/2000 | Chen et al. |
| 6,186,880 | B1 | 2/2001 | Gonzalez et al. |
| 6,224,472 | B1 | 5/2001 | Lai et al. |
| 6,234,875 | B1 | 5/2001 | Pendergrass, Jr. |
| 6,251,215 | B1 | 6/2001 | Zuniga et al. |
| 6,347,979 | B1 | 2/2002 | Drill |
| 6,390,904 | B1 | 5/2002 | Gleason et al. |
| 6,413,153 | B1 | 7/2002 | Molar |
| 6,419,567 | B1 | 7/2002 | Glashauser |
| 6,468,136 | B1 | 10/2002 | Lum et al. |
| 6,471,566 | B1 | 10/2002 | Mikhaylich et al. |
| 6,602,114 | B1 | 8/2003 | Wang et al. |
| 6,612,917 | B1 | 9/2003 | Bruxvoort |
| 6,623,337 | B1 | 9/2003 | Scott et al. |
| 6,641,463 | B1 | 11/2003 | Molnar |
| 6,705,932 | B1 * | 3/2004 | Zuniga et al. ..... 451/397 |
| 6,719,615 | B1 | 4/2004 | Molnar |
| 6,758,939 | B1 | 7/2004 | Marquardt et al. |
| 6,899,610 | B1 | 5/2005 | Cooper et al. |
| 2002/0058426 | A1 | 5/2002 | Mandigo et al. |
| 2002/0106980 | A1 | 8/2002 | Bruxvoort |
| 2002/0111120 | A1 | 8/2002 | Goetz |
| 2002/0173255 | A1 | 11/2002 | Shendon et al. |
| 2003/0148614 | A1 | 8/2003 | Simpson et al. |
| 2004/0023609 | A1 | 2/2004 | Oshita et al. |

(Continued)

FOREIGN PATENT DOCUMENTS

| | | | |
|---|---|---|---|
| EP | 1 243 617 | A1 | 9/2002 |

(Continued)

*Primary Examiner*—Lee D. Wilson
(74) *Attorney, Agent, or Firm*—Larson Newman Abel Polansky & White, LLP; Chi Suk Kim

(57) ABSTRACT

In one embodiment, the disclosure is directed to a chemical mechanical polishing retaining ring. The chemical mechanical polishing retaining ring includes a support formed of a first material comprising a first polymer and a wear portion formed of a second material comprising a second polymer. The first material has an elastic modulus greater than the elastic modulus of the second material.

45 Claims, 2 Drawing Sheets

U.S. PATENT DOCUMENTS

| | | | | |
|---|---|---|---|---|
| 2004/0040656 | A1 | 3/2004 | Hengel, Jr. et al. | |
| 2004/0065412 | A1 | 4/2004 | Ensinger | |
| 2004/0067723 | A1 | 4/2004 | Ensinger | |
| 2005/0208881 | A1* | 9/2005 | Wilkinson et al. | 451/41 |
| 2005/0215181 | A1* | 9/2005 | Wilkinson et al. | 451/41 |

FOREIGN PATENT DOCUMENTS

| | | | |
|---|---|---|---|
| EP | 1 386 695 | A2 | 2/2004 |
| EP | 1 418 614 | A1 | 5/2004 |
| WO | WO 02/066207 | A1 | 8/2002 |

* cited by examiner

CHEMICAL MECHANICAL POLISHING RETAINING RING WITH INTEGRAL POLYMER BACKING

TECHNICAL FIELD

The disclosure, in general, relates to chemical mechanical polishing retaining rings and methods for performing chemical mechanical polishing.

BACKGROUND

In semiconductor fabrications, chemical mechanical polishing (CMP) is used for planarization of semiconductor wafers that may be used for the fabrication of very large scale integrated (VLSI) circuits and ultra large scale integrated (ULFI) circuits. Chemical mechanical polishing (CMP), generally, removes material from a layer of a wafer. In a typical CMP process, the wafer is exposed to an abrasive medium under controlled chemical, pressure, velocity, and temperature conditions. The abrasive medium may include slurry solutions containing small abrasive particles such as silicon dioxide and chemically reactive substances such as potassium hydroxide.

Typical chemical mechanical polishing (CMP) processes include a carrier head that holds a wafer against polishing pad. One or both of the polishing pad or carrier head may rotate to effect the polishing of the wafer. Generally, carrier heads include a retaining ring used to hold the wafer within a given boundary. In general, retaining rings are formed either completely of a metal construction or a metal backing with a ring portion of polymer or silicon dioxide. The ring portion typically contacts the polishing pad or surface and the semiconductor wafer.

Typical designs may cause damage to chip edges and surfaces. These designs may further lead to scratched wafer surfaces and altered device properties. As such, an improved CMP retaining ring would be desirable.

SUMMARY

In one embodiment, the disclosure is directed to a chemical mechanical polishing retaining ring. The chemical mechanical polishing retaining ring includes a support portion formed of a first material comprising a first polymer and a wear portion formed of a second material comprising a second polymer. The first material has an elastic modulus greater than the elastic modulus of the second material.

In a further embodiment, the disclosure is directed to a chemical mechanical polishing retaining ring. The chemical mechanical polishing retaining ring includes a support formed of a first material comprising a first polymer matrix and filler and a wear portion formed of a second material comprising a second polymer.

In another embodiment, the disclosure is directed to a chemical mechanical polishing apparatus for wafer polishing. The chemical mechanical polishing apparatus includes a polishing pad having a polishing surface and a substrate carrier head having a substrate backing member and a retaining ring. The retaining ring has a first member comprising a first polymer and a second member comprising a second polymer. The first member has an elastic modulus greater than the elastic modulus of the second member.

In a further embodiment, the disclosure is directed to a semiconductor device formed via a process including a polishing step. The polishing step utilizes a polishing apparatus that includes a polishing pad having a polishing surface and a substrate carrier head. The substrate carrier head has a substrate backing member and a retaining ring. The retaining ring has a first member comprising a first polymer and a second member comprising a second polymer. The first member has an elastic modulus greater than the elastic modulus of the second member.

In another embodiment, the disclosure is directed to a method of forming a semiconductor device. The method includes providing a substrate wafer, polishing the substrate wafer with a chemical mechanical polishing apparatus, and forming semiconductor circuitry on the substrate wafer. The chemical mechanical polishing includes a polishing pad having a polishing surface and a substrate carrier head. The substrate carrier head has a substrate backing member and a retaining ring. The retaining ring has a first member comprising a first polymer and a second member comprising a second polymer. The first member has an elastic modulus greater than the elastic modulus of the second member.

BRIEF DESCRIPTION OF THE DRAWINGS

The present disclosure may be better understood, and its numerous objects, features, and advantages made apparent to those skilled in the art by referencing the accompanying drawings.

The use of the same reference symbols in different drawings indicates similar or identical items.

DETAILED DESCRIPTION

The disclosure is directed to a chemical mechanical polishing (CMP) apparatus having a CMP retaining ring. In one particular embodiment, the CMP retaining ring is formed of two polymeric materials. The first material includes a polymer, such as polyphenylsulfide (PPS), and filler, such as a polymer, fiberglass or carbon. Alternately, the first material may include a cross-linked polymer. The first material forms a structural component of the CMP retaining ring. The second material includes a polymer and forms a second component of the CMP retaining ring. The second component may contact the wafer and a polishing pad. The disclosure is also directed to a method of producing an integrated circuit device that includes performing CMP using the CMP retaining ring.

Figure 1:
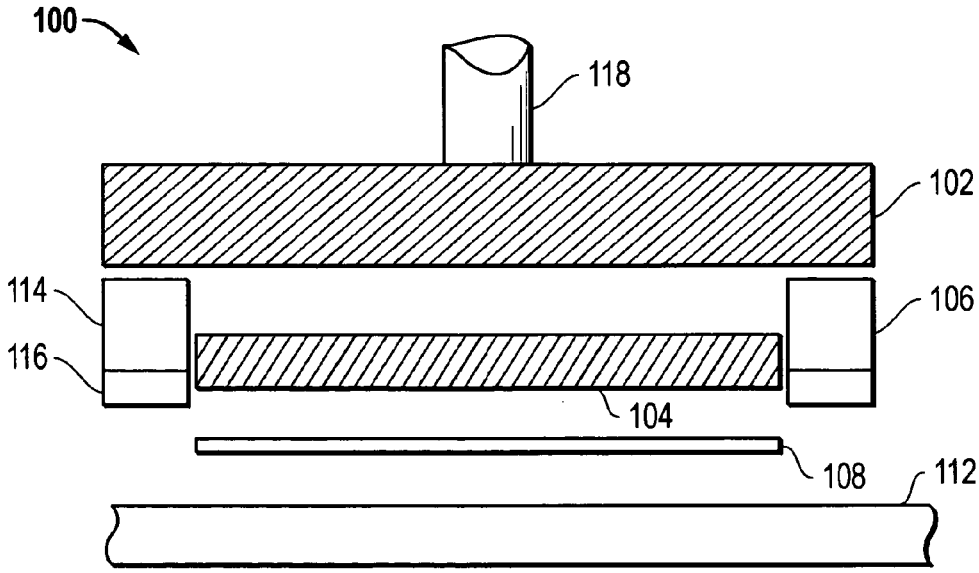
FIG. 1 depicts an exemplary chemical mechanical polishing apparatus.

FIG. 1 depicts an exemplary chemical mechanical polishing (CMP) apparatus 100. The CMP apparatus 100 includes a carrier 102 and a polishing pad having a polishing surface 112. The carrier 102 includes a wafer backing member 104 and retaining ring 106. The retaining ring 106 and the wafer backing member 104 hold a wafer 108 in place and in contact with the wafer polishing surface 112 during the CMP process. Various mechanisms (not shown) may be used to exert force on wafer 108, such as bellows and other pneumatic mechanisms, which cause wafer backing member 104 to exert force on the wafer 108 in contact with the polishing surface 112. In practice, the polishing may be accomplished with the introduction of a chemical mechanical abrasive medium. The carrier 102 and/or the polishing surface 112 may rotate to facilitate mechanical abrasion.

The retaining ring 106 acts to retain or surround the wafer 108 and horizontally hold the wafer 108 in contact with the wafer backing member 104. The retaining ring 106 generally surrounds the wafer backing member 104. The retaining ring 106 generally extends below the wafer backing member 104 to form a recess for receiving the wafer 108 and effectively bound the wafer 108. The CMP retaining ring 106 generally contacts the chemical mechanical polishing surface 112 during a CMP process. In an alternate embodiment, the retaining ring 106 may extend partially along the vertical edge of the wafer and may or may not contact the polishing surface 112 during the CMP process. The retaining ring 106 may be connected to the carrier 102 using various mechanisms such as fasteners, latches, screws, pins, adhesives, and other connecting or coupling methods.

In the exemplary embodiment of FIG. 1, the retaining ring 106 may include an upper backing portion 114 and a lower contact or wear portion 116. In this exemplary embodiment the lower portion 116 contacts both the wafer 108 and the polishing surface 112 during a CMP process.

In one particular embodiment, the retaining ring may include a lower portion 116 formed of a polymer and an upper portion 114. The polymer of the lower portion 116 may be a polymer such as polyphenylsulfide (PPS), polyethylene terephthalate (PET), polyetheretherketone (PEEK), polyimide (PI), and polybutylene terephthalate (PBT), acetal polyoxymethylene (POM), polyamideimide (PAI), polybenzimidazole (BPI), or combinations thereof. Further, the polymer may be a blend, such as, for example, the combinations PEEK/PI or PPS/PI. In another exemplary embodiment, PI may be used as filler in a base of PEEK or PPS polymers. In a further exemplary embodiment, the polymer may be a crosslinked single polymer or crosslinked blend of polymers.

In one exemplary embodiment, the lower portion 116 may include filler. The filler may be organic or inorganic filler. For example, the filler may be carbon, aramide, $TiO_2$, $SiO_2$, alumina, boron nitride, silicon carbide, PTFE, polyester. Fillers may, for example, include abrasives or ceramic. In exemplary embodiments, the filler may include a polymer, such as PTFE, polyester, aramide, PPS, PEEK, polyimide, and combinations thereof. The filler may, for example, be in the form of particulate, fiber or beads. For example, the filler may be a woven fiber, such as a fiberglass or polymeric fabric. In another exemplary embodiment, the filler may be a continuous fiber, such as a fiberglass, carbon, or polymeric fiber. In a further exemplary embodiment, the filler may include carbon in the form of nanotubes, fibers, woven fibers, and continuous fibers. Fibrous materials include materials comprising fibers, woven fibers, continuous fibers, or combinations thereof. The filler may be loaded in percentages between about 5%–95% by weight. For example, the filler may be loaded in percentages between about 5%–50% by weight, such as between about 5% and 30% by weight or between about 20%–50% by weight. In another exemplary embodiment, the filler may be loaded in percentages between about 50% and 85% by weight.

Generally, the lower portion has an elastic modulus of greater than about 350,000 psi, such as greater than about 380,000 psi and greater than about 400,000 psi. Elastic modulus may, for example, be measured using the method described in ASTM D638. The elastic modulus of the lower portion 116 will typically be less than the elastic modulus of the upper portion 114. For example, the percent difference of elastic modulus between the lower portion 116 and the upper portion 114 may be greater than about 5%, such as greater than about 10%, 15% or 20% higher.

The lower portion 116 may be bonded or molded to the backing portion 114. The retaining ring may have an upper portion 114 formed of a polymer matrix material and a filling material. The polymer matrix may be formed of a polymer such as polyphenylsulfide (PPS), polyethylene terephthalate (PET), polyetheretherketone (PEEK), polyimide (PI), and polybutylene terephthalate (PBT), acetal polyoxymethylene (POM), polyamideimide (PAI), polybenzimidazole (BPI), or combinations thereof. In one exemplary embodiment, the polymer is PEEK or PPS. In another exemplary embodiment, the polymer may be a crosslinked single polymer or crosslinked blend of polymers. For example, the polymer may include a cross-linked blend of PEEK and PPS.

The upper portion 114 may also include a filling material. The filling material may be organic or inorganic filler. Exemplary embodiments include fillers such as carbon, aramide, $TiO_2$, $SiO_2$, alumina, boron nitride, silicon carbide, PTFE, polyester. The filler may be an abrasive or ceramic. In exemplary embodiments, the filler may include a polymer, such as PTFE, polyester, aramide, PPS, PEEK, polyimide, and combinations thereof. The filler may, for example, be in the form of particulate, fiber or beads. For example, the filler may be a woven fiber, such as a fiberglass or polymeric fabric. In another exemplary embodiment, the filler may be a continuous fiber, such as a fiberglass, carbon, or polymeric fiber. In a further exemplary embodiment, the filler may include carbon in the form of nanotubes, fibers, woven fibers, and continuous fibers. In other exemplary embodiments, the filler may include such fillers as those listed above in relation to lower portion 116. The backing or upper portion 114 may be formed with the polymer matrix and the filling material. The filling material may comprise between about 5% and about 95% by weight of the backing 114. In one exemplary embodiment, the filing material may be between about 25% and about 90% by weight of upper portion 114. In one particular embodiment, the upper portion 114 may be a filled polymer portion including between about 25% and about 60% by weight filling material. In another exemplary embodiment, an upper portion 114 may be a composite material comprising between about 60% and about 90% filling material by weight. In further exemplary embodiments, the filler loading may be between about 20% and about 50% or between about 40% and about 70%.

Generally, the elastic modulus of the upper portion 114 will be greater than about 400,000 psi. For example, the elastic modulus of the upper portion 114 may be greater than about 500,000 psi, greater than about 1,000,000 psi, or as high as 20,000,000 psi. Elastic modulus may, for example, be measured using the method described in ASTM D638. The elastic modulus of the lower portion 116 will typically be less than the elastic modulus of the upper portion 114. For example, the percent difference of elastic modulus between the lower portion 116 and the upper portion 114 may be greater than about 5%, such as greater than about 10%, 15% or 20% higher. In one exemplary embodiment, the elastic modulus of the upper portion 114 may be, for example, greater than 2 times that of the lower portion 116. For examples, the elastic modulus of the upper portion 114 may be greater than about 3, 5, or 8 times that of the lower portion 116.

In one particular embodiment, the polymer of the lower portion 116 and the polymer forming the polymer matrix of the upper portion 114 may be formed of the same polymer, such as polyphenylsulfide (PPS), polyethylene terephthalate (PET), polyetheretherketone (PEEK), polyimide (PI), and polybutylene terephthalate (PBT), acetal polyoxymethylene (POM), polyamideimide (PAI), polybenzimidazole (BPI), or combinations thereof. In a further exemplary embodiment, the polymer of lower portion 116 and the polymer of upper portion 114 may be formed from a common monomer, such as those monomers used in the formation of the polymers listed above. In another exemplary embodiment, the polymer may be a crosslinked polymer or crosslinked blend of polymers. For example, the polymer may include a crosslinked blend of PEEK and PPS. The upper portion 114 may include fillers, such as fiberglass, carbon, or combinations thereof.

In one embodiment, the lower portion 116 may be designed to wear and exhibit elasticity. The upper portion 114 may provide structural support and may exhibit lower elasticity. In one exemplary embodiment, the upper portion 114 is stiffer than the lower portion 116. In another exemplary embodiment, the lower portion 116 has a lower Young's modulus than the upper portion 114. For example, the Young's Modulus of the lower portion 116 may be 20% lower than that of the upper portion 114.

In a further exemplary embodiment, the retaining ring 106 may include one or more additional layers. For example, an additional polymeric layer may exist above layer 114 and may be formed to attach to carrier 102. The exemplary polymeric layer is formed of a polymer, such as a thermoplastic. In an exemplary embodiment, the polymer is non-elastomeric. In another exemplary embodiment, the polymer has an elastic modulus greater than about 75,000 psi. For example, the polymer may be PPS, PET, PEEK, PI, PBT, POM, PAI, BPI, or combinations thereof. In another exemplary embodiment, the polymer may be a crosslinked polymer or crosslinked blend of polymers and may include fillers, such as those listed above. In addition, the additional polymeric layer may attach, couple, or connect to carrier 102 using the methods disclosed above.

Figure 2A:
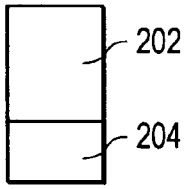
FIGS. 2A–2F depict exemplary configurations of a CMP retaining ring.

FIGS. 2A–2E depict exemplary configurations of a CMP retaining ring. FIG. 2A depicts an exemplary embodiment in which a lower portion 204 is connected to an upper portion 202. This arrangement, shown in FIG. 2A may, for example, be formed through co-extruding miscible or compatible polymer layers, co-forming, compression molding, or adhesively coupling layers.

Figure 2B:
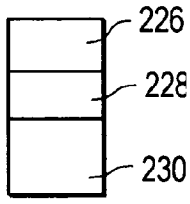

FIG. 2B depicts an exemplary three-layer structure. Layer 230 may be a lower wear portion. Layer 228 may be an upper structural support portion with a higher elastic modulus. Layer 226 may include a polymeric material having properties that lend to machinability and tooling such that connective structures may be formed for connection of the retaining ring to carriers. In one exemplary embodiment, layer 226 has similar composition to that of layer 230. As with the structures of FIG. 2A, the exemplary embodiment of FIG. 2B may be formed through co-forming, compression molding, or adhesively coupling layers.

Figure 2C:
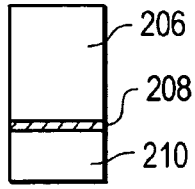

FIG. 2C depicts an embodiment in which a lower portion 210 is bonded to an upper portion 206 with a bonding layer 208, such as an adhesive. In one exemplary embodiment, the bonding layer 208 may be an epoxy, such as a two-component epoxy or a slow curing epoxy.

Figure 2D:
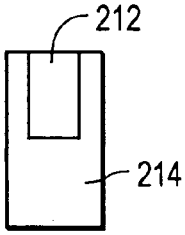
Figure 2E:
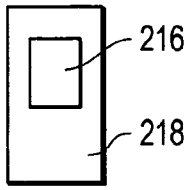
Figure 2F:
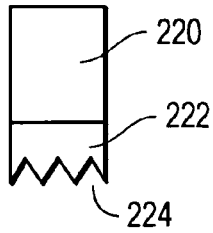

FIGS. 2D and 2E depict alternate embodiments in which a support portion 212 or 216 are surrounded or encased by a second portion 214 or 218, respectively. FIG. 2F depicts a further embodiment in which an upper support portion 220 is connected to lower portion 222. The lower support portion 222 has a grooved or shaped surface 224, which may act to guide the flow of abrasive mediums and slurries. Further exemplary embodiments include combinations of those examples shown in FIGS. 2A–2F.

The exemplary embodiments shown in 2A–2F may be formed through several methods, such as injection molding, compression molding, extruding, and bonding. In one exemplary embodiment, the portions may be co-extruded. In another exemplary embodiment, the portions may be separately extruded and bonded together using adhesives such as glues and epoxies, such as a two-part epoxy or a slow curing epoxy. In a further embodiment, a first portion may be formed and a second portion molded around the first portion.

Figure 3:
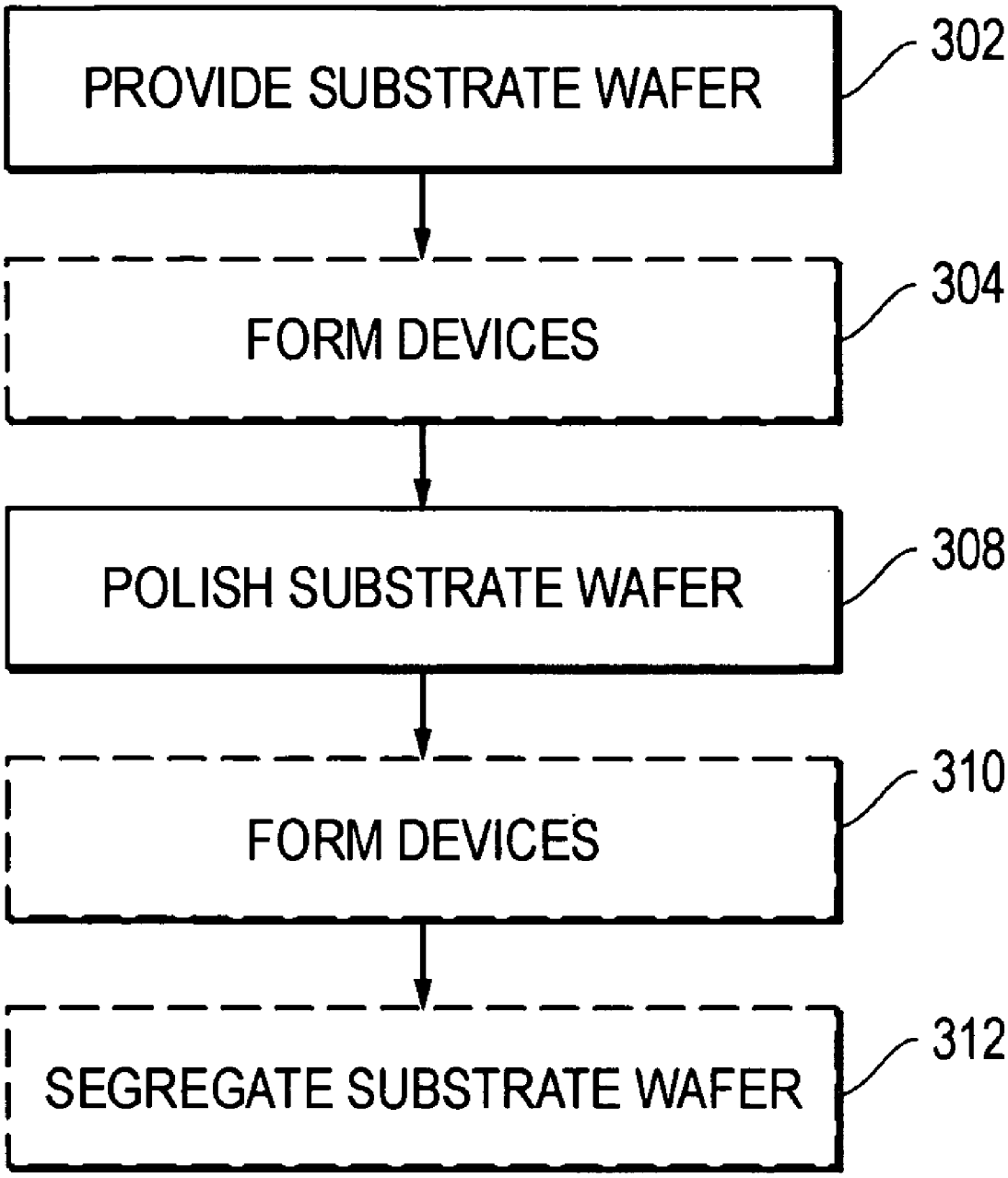
FIG. 3 depicts an exemplary method of chemical mechanical polishing.

A CMP process utilizing the exemplary retainer rings may be used to form semiconductor and integrated circuit devices. In one exemplary method shown in FIG. 3, a substrate wafer may be provided, as shown at step 302, the substrate wafer may, for example be formed of silicon or gallium. CMP processes may be used at various points during the integrated circuit process. In one exemplary embodiment, devices may be formed on the substrate wafer as shown at step 304 and the wafer subsequently polished, as shown at step 308. For example, devices may be formed in the wafer and connected using a conductive metal layer. CMP processing may be used to remove excess conductive metal to form lines and interconnects. In one exemplary embodiment, metal, such as tungsten, aluminum, copper, or alloys of thereof, is sputtered or deposited on the wafer surface. Excess metal is polished and removed to leave patterned lines of interconnects and expose the underlying dielectric layer.

In another exemplary embodiment, the wafer may be polished, as shown at step 308, and devices formed, as shown at step 310. CMP processes may, for example, be used on the front end polishing prior to and during integrated circuit formation. In another exemplary embodiment, CMP polishing may be used in back end processing to reduce wafer thickness.

The polishing step shown at step 308 may be performed with a chemical mechanical polishing apparatus that includes a retaining ring having a wear portion formed of a polymer and a support portion formed with a polymer matrix and a filling material. CMP processing may utilize a slurry or abrasive medium. The slurry may include oxidizers, such as hydrogen peroxide or potassium hydroxide; etchants, such as organic acids; and corrosion inhibitors, such as benzotriazole (BTA). The slurry may further include abrasives, such as alumina or silica.

The substrate wafer may then be segregated into individual integrated circuit devices, as shown at step 312, and further processed to allow connection to and use of the integrated circuit. Such a process utilizing the CMP apparatus with the retaining ring may improve yield and effectiveness of integrated circuit devices.

Aspects of the invention include a reduction in wafer damage. Metal components in the retaining ring may, if the metal component is in contact with the wafer, damage or chip the wafers' edges, reducing available surface area for effective production of semiconductor devices. Metal may contaminate the abrasive medium or slurry with metal particles and ions, which may further damage the wafer either mechanically or chemically. The invention may improve wafer yield.

The above-disclosed subject matter is to be considered illustrative, and not restrictive, and the appended claims are intended to cover all such modifications, enhancements, and other embodiments, which fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A chemical mechanical polishing retaining ring comprising:

a support portion formed of a first material comprising a first polymer and between about 5% and about 95% by weigh of a filler; and a wear portion formed of a second material comprising a second polymer; the first material having an elastic modulus greater than the elastic modulus of the second material.

2. The chemical mechanical polishing retaining ring of claim 1, wherein the filler comprises between about 25% and about 60% by weight of the first material.

3. The chemical mechanical polishing retaining ring of claim 1, wherein the filler comprises between about 60% and about 90% by weight of the first material.

4. The chemical mechanical polishing retaining ring of claim 1, wherein the filler is selected from the group consisting of carbon, glass, ceramic, polymer and combinations thereof.

5. The chemical mechanical polishing retaining ring of claim 1, wherein the filler comprises a fibrous material.

6. The chemical mechanical polishing retaining ring of claim 1, wherein the filler is selected from the group consisting of carbon, $TiO_2$, ceramic, silica, alumina, boron nitride, silicon carbide, aramide, PBS, PEEK, PTFE, polyester and combinations thereof.

7. The chemical mechanical polishing retaining ring of claim 1, wherein the first polymer comprises a crosslinked polymer.

8. The chemical mechanical polishing retaining ring of claim 1, wherein the wear portion comprises a second filler.

9. The chemical mechanical polishing retaining ring of claim 8, wherein the second filler comprises between about 5% and about 85% by weight of the second material.

10. The chemical mechanical polishing retaining ring of claim 1, wherein the wear portion is configured to contact a polishing surface during a chemical mechanical polishing process.

11. The chemical mechanical polishing retaining ring of claim 1, wherein the wear portion is configured to contact a wafer periphery during a chemical mechanical polishing process.

12. The chemical mechanical polishing retaining ring of claim 1, wherein the wear portion forms an axial end of the chemical mechanical polishing retaining ring.

13. The chemical mechanical polishing retaining ring of claim 1, wherein the first polymer is selected from the group consisting of polyphenylsulfide (PPS), polyethylene terephthalate (PET), polyetheretherketone (PEEK), polyimide (PT), and polybutylene terephtbalate (PBT), acetal polyoxymethylene (POM), polyamideimide (PAI), polybenzimidazole (BPI), and combinations thereof.

14. The chemical mechanical polishing retaining ring of claim 1, wherein the second polymer is selected from the group consisting of polyphenylsulfide (PPS), polyethylene terephthalate (PET), polyetheretherketone (PEEK), polyimide (PI), and polybutylene terephthalate (PBT), acetal polyoxymethylene (POM), polyamideimide (PAI), polybenzimidazole (BPI), and combinations thereof.

15. The chemical mechanical polishing retaining ring of claim 1, wherein the first polymer and the second polymer are formed from a common monomer.

16. The chemical mechanical polishing retaining ring of claim 1, wherein the first material has an elastic modulus greater than about 400,000 psi.

17. A chemical mechanical polishing retaining ring comprising:

a support portion formed of a first material comprising a first polymer;

a wear portion formed of a second material comprising a second polymer: the first material having an elastic modulus greater than the elastic modulus of the second material; and a coupling layer formed of a third material and configured for coupling the chemical mechanical polishing retaining ring to a carrier, wherein the third material comprises a polymer selected from the group consisting of the first polymer and the second polymer.

18. A chemical mechanical polishing retaining ring comprising:

a support formed of a first material comprising a first polymer matrix and between about 5% and about 95% by weight of a filler; and a wear portion formed of a second material comprising a second polymer.

19. The chemical mechanical polishing retaining ring of claim 18, further comprising a coupling layer formed of a third material and configured for coupling the chemical mechanical polishing retaining ring to a carrier.

20. The chemical mechanical polishing retaining ring of claim 19, wherein the third material comprises a polymer selected from the group consisting of the first polymer and the second polymer.

21. The chemical mechanical polishing retaining ring of claim 18, wherein the filler comprises between about 25% and about 90% by weight of the first material.

22. The chemical mechanical polishing retaining ring of claim 18, wherein the filler comprises between about 25% and about 60% by weight of the first material.

23. The chemical mechanical polishing retaining ring of claim 18, wherein the filler comprises between about 60% and about 90% by weight of the first material.

24. The chemical mechanical polishing retaining ring of claim 18, wherein the filler is selected from the group consisting of glass, carbon, ceramic, and combinations thereof.

25. The chemical mechanical polishing retaining ring of claim 18, wherein the filler comprise fibrous material.

26. The chemical mechanical polishing retaining ring of claim 18, wherein the wear portion comprises a second filler.

27. The chemical mechanical polishing retaining ring of claim 18, wherein the wear portion is configured to contact a polishing surface during a chemical mechanical polishing process.

28. The chemical mechanical polishing retaining ring of claim 18, wherein the wear portion is configured to contact a wafer periphery during a chemical mechanical polishing process.

29. The chemical mechanical polishing retaining ring of claim 18, wherein the wear portion forms an axial end of the chemical mechanical polishing retaining ring.

30. The chemical mechanical polishing retaining ring of claim 18, wherein the first polymer matrix comprises polymer selected from the group consisting of polyphenylsulfide (PPS), polyethylene terephthalate (PET), polyetheretherketone (PEEK), polyimide (PT), and polybutylene terephthalate (PBT), acetal polyoxymethylene (POM), polyamideimide (PAI), polybenzimidazole (BPI), and combinations thereof.

31. The chemical mechanical polishing retaining ring of claim 18, wherein the first polymer matrix comprises a crosslinked polymer.

32. The chemical mechanical polishing retaining ring of claim 18, wherein the second polymer is selected from the group consisting of polyphenylsulfide (PPS), polyethylene terephthalate (PET), polyetheretherketone (PEEK), polyimide (PI), and polybutylene terephthalate (PBT), acetal polyoxymethylene (POM), polyamideimide (PAI), polybenzimidazole (BPI), and combinations thereof.

33. The chemical mechanical polishing retaining ring of claim 18, wherein the first material has an elastic modulus greater than the second material elastic modulus.

34. A chemical mechanical polishing apparatus for wafer polishing, the chemical mechanical polishing apparatus comprising:

a polishing pad having a polishing surface; and a substrate carrier head having a substrate backing member and a retaining ring, the retaining ring having a first member comprising a first polymer and a second member comprising a second polymer; the first member having an elastic modulus greater than the elastic modulus of the second member, the first member comprising between 25% and 90% by weight of a filler.

35. The chemical mechanical polishing apparatus of claim 34, wherein the first polymer comprises crosslinked polymer.

36. The chemical mechanical polishing apparatus of claim 34, wherein the second member is configured to contact a polishing surface during a chemical mechanical polishing process.

37. The chemical mechanical polishing apparatus of claim 34, wherein the second member is configured to contact a wafer periphery during a chemical mechanical polishing process.

38. The chemical mechanical polishing apparatus of claim 34, wherein the substrate backing member is coaxially arranged inside the retaining ring forming a space configured to receive a wafer.

39. A semiconductor device formed via a process comprising a polishing step that utilizes a polishing apparatus comprising a polishing pad having a polishing surface and a substrate carrier head, the substrate carrier head having a substrate backing member and a retaining ring, the retaining ring having a first member comprising a first polymer and a second member comprising a second polymer, the first member having an elastic modulus greater than the elastic modulus of the second member, the first member comprising between 25% and 90% by weight of a filler.

40. The semiconductor device of claim 39, wherein the second member is configured to contact a polishing surface during a chemical mechanical polishing process.

41. The semiconductor device of claim 39, wherein the second member is configured to contact a wafer periphery during a chemical mechanical polishing process.

42. A method of forming a semiconductor device, the method comprising:

providing a substrate wafer;

polishing the substrate wafer with a chemical mechanical polishing apparatus, the chemical mechanical polishing comprising a polishing pad having a polishing surface and a substrate carrier head, the substrate carrier head having a substrate backing member and a retaining ring, the retaining ring having a first member comprising a first polymer and a second member comprising a second polymer, the first member having an elastic modulus greater than the elastic modulus of the second member, the first member comprising between 25% and 90% by weight of a filler; and forming semiconductor circuitry on the substrate wafer.

43. The method of claim 42, wherein the second member is configured to contact a wafer periphery during a chemical mechanical polishing process.

44. The method of claim 42, wherein the first polymer is selected from the group consisting of polyphenylsulfide (PPS), polyethylene terephthalate (PET), polyetheretherketone (PEEK), polyimide (PI), and polybutylene terephthalate (PBT), acetal polyoxymethylene (POM), polyamideimide (PAI), polybenzimidazole (BPI), and combinations thereof.

45. The method of claim 42, wherein the second polymer is selected from the group consisting of polyphenylsulfide (PPS), polyethylene terephthalate (PET), polyetheretherketone (PEEK), polyimide (PI), and polybutylene terephthalate (PBT), acetal polyoxymethylene (POM), polyamideimide (PAI), polybenzimidazole (BPI), and combinations thereof.

* * * * *

UNITED STATES PATENT AND TRADEMARK OFFICE

CERTIFICATE OF CORRECTION

PATENT NO. : 7,086,939 B2
APPLICATION NO. : 10/804569
DATED : August 8, 2006
INVENTOR(S) : Wilkinson et al.

It is certified that error appears in the above-identified patent and that said Letters Patent is hereby corrected as shown below:

Column 7, Line 27: Please change “PBS” to --PPS--

Column 7, Line 52: Please change “terephtbalate” to --terephthalate--

Signed and Sealed this

Twenty-seventh Day of February, 2007

JON W. DUDAS
*Director of the United States Patent and Trademark Office*